United States Patent [19]

Srinivasan et al.

[11] 3,991,001

[45] Nov. 9, 1976

[54] SOAP BARS

[75] Inventors: Ganapathy Srinivasan, Bombay, India; Richard Michael Twemlow, West Kirby, England; Srinivasan Varadarajan, Gujarat, India

[73] Assignee: Lever Brothers Company, New York, N.Y.

[22] Filed: Dec. 24, 1974

[21] Appl. No.: 536,151

[30] Foreign Application Priority Data

Dec. 28, 1973 United Kingdom..... 60076/73
Nov. 19, 1974 United Kingdom..... 50014/74

[52] U.S. Cl...... 252/117; 252/110; 252/132; 252/DIG. 16

[51] Int. Cl.[2]..... C11D 9/30

[58] Field of Search ..... 252/117, 92, 110, 132, 252/DIG. 16

[56] References Cited

UNITED STATES PATENTS

| | | | |
|---|---|---|---|
| 3,494,869 | 2/1970 | Armstrong | 252/DIG. 16 |
| 3,507,797 | 4/1970 | Mazumder | 252/110 |

*Primary Examiner*—William E. Schulz
*Attorney, Agent, or Firm*—Kenneth F. Dusyn; James J. Farrell; Melvin H. Kurtz

[57] ABSTRACT

A toilet soap bar having improved lathering properties contains as superfatting agent a clathrate of urea and a free fatty acid, the amount of urea and free fatty acid present being not more than about 40% by weight of the total soap, urea and free fatty acid.

6 Claims, No Drawings

SOAP BARS

This invention relates to toilet soap bars and to processes for their preparation.

When a soap tablet is used for personal washing, the tablet is rubbed with wet hands until they are coated with a concentrated solution of soap in the form of a lather. The user associates effectiveness of the soap with its readiness to lather and the appearance of the lather formed. It is customary to give the soap improved lathering properties by the incorporation of free long-chain fatty acid, and the effect which this gives is known as superfatting. The quality of the lather formed is assessed subjectively by the user: it can be expressed in part as a combination of lather volume and lather viscosity, but there remain factors which cannot be reduced to physical measurement: one of these is a property known as creaminess, which can be assessed by a small panel of trained users: even so, the ultimate test for these subjective properties can only be provided by large scale consumer testing.

Another property which is important to the user is the rate of wear of the tablet over a period of use, during which the tablet is repeatedly wetted, rubbed with the hands, and allowed to dry on a soap dish.

It has now been discovered that by converting some or all of the free fatty acids into an inclusion compound with urea known as a clathrate, the lathering properties are improved, particularly in respect of lather volume and viscosity, and creaminess characteristics.

British Pat. No. 1,163,925 describes the preparation of soap bars based on compositions containing 35–60% of urea and 7–15% of fatty acid which are heated to form the inclusion compound: the urea thus incorporated provides the soap bars with a skin-coolant effect which the user finds attractive. Such compositions provide good lather volume and viscosity characteristics, but the soap bars have a very high rate of wear. It has been found that the amounts of urea clathrate lower than those employed in the process of British Pat. No. 1,163,925 for the skin-coolant effect of the urea, provide improved lathering properties without the unacceptably high rate of wear shown by the skin-coolant bars. There results an unexpectedly advantageous compromise between the improvement in lather characteristics and the increase in rate of wear which inevitably takes place when urea is incorporated in soap, because of the high water-solubility of urea.

Clathrate compounds between long-chain fatty acids and urea are well known: irrespective of the precise length of the fatty acid chain, a loose association is formed between about 3 parts by weight of urea and 1 part of free fatty acid. Where a soap is prepared containing urea and free fatty acid, the clathrate containing that ratio is present in the bar even where the clathrate is not formed before incorporation into the soap, because the normal conditions of soap tablet production can provide intimate mixing sufficient to form clathrate from urea and free fatty acid added independently. Where more or less than the equivalent of urea to free fatty acid required for the clathrate is incorporated, the excess of one component over the other can be regarded as remaining in the free state. In this specification both the clathrate and any excess of one conponent over the other are expressed simply as the ratio of the total urea to the total free fatty acid present.

The present invention provides an improvement in a toilet soap bar containing a superfatting agent, wherein the superfatting agent is a clathrate of urea and a free fatty acid (such as a straight-chain fatty acid having from about 8 to about 22 carbon atoms) in which the amount of urea and free fatty acid present is not more than about 40% by weight of the total soap, urea and free fatty acid. The clathrate can be provided by a ratio of urea to free fatty acid of from about 0.1:1 to about 10:1 by weight, the combined amount of urea and free fatty acid being from about 2 to about 40% by weight of the total soap, urea and free fatty acid. The amount of soap thus expressed is on a dry-weight basis, it being understood that a soap bar necessarily contains a sufficient amount of water to give the plastic qualities that are required for a bar. The amount of water varies according to the chemical composition of the soap bar, but is generally within the range of from 7 to 15% by weight of the bar.

The amount of free fatty acid by weight of the soap can be within the range from 1 to 20% and is preferably 3 to 15%: and by weight of the total soap, urea and free fatty acid is preferably less than 20%, especially less than 15%. Preferably the soap bar has less than 30%, and especially less than 25% of urea by weight of the total soap, urea and free fatty acid. It preferably has a ratio of from 0.2:1 to 6:1, and especially from 0.3:1 to 3.5:1 of urea to the free fatty acid. Advantageously the amount of urea is not more than that required to form clathrate from all the free fatty acid present. Thus a soap bar can contain from 1.5 to 3 parts of urea for each part of the free fatty acid, and the amount of urea and free fatty acid together can be from 15 to 40%, and particularly 20 to 30%, by weight of the total soap, urea and free fatty acid. The amount of urea and free fatty acid by total weight of soap, urea and free fatty acid is preferably less than 35 or 30%, more preferably from 5 to 25%, and especially from 8 to 20%.

Soap bars include both billets, which are obtained by cutting soap extruded from an orifice, and tablets, which are shaped by stamping.

The preparation of toilet soap bars, as is well known by those skilled in soap manufacture, requires the use of water-soluble soap from a fat charge that is capable of giving a combination of individual soaps of fatty acids suitable for the formation of a plastic bar. Within this requirement, individual soap compounds can be alkali metal, ammonium or substituted ammonium salts, preferably sodium or potassium salts, of long-chain fatty acids. Normally such fatty acids will be straight chain saturated or unsaturated fatty acids of from 8 to 22 carbon atoms. Suitable such fatty acids are the fatty acids of tallow, groundnut, cottonseed, palm, palm kernel, babassu, and coconut oils, for instance lauric, myristic, palmitic, oleic, and stearic acids and the acids of dehydrated hardened castor oil; or erucic and behenic acids. Typical mixtures of such acids suitable for the formation of soaps for a soap bar are, for example, mixtures containing from 30 to 95% by weight of tallow fatty acid and from 70 to 5% by weight of coconut oil fatty acid, and especially from 40 to 80% tallow fatty acid and from 60 to 20% coconut oil fatty acid. It is also well understood that the plasticity of the soap bar can be conferred by including a suitable proportion of a relatively soft soap, for instance soap derived from an unsaturated fatty acid such as oleic acid, or a potassium soap rather than a sodium soap. The required plasticity can also be provided by the incorporation of a small amount, for instance up to 5%, of a suitable plasticiser, for example sodium dodecylbenzene sulphonate.

The general structural requirements for a fatty acid to form a urea clathrate are well-known, and whether any unusual fatty acid will form a urea clathrate is easily tested. The presence of a urea-fatty acid clathrate in a urea-free fatty acid composition or a soap bar can normally be detected from X-ray powder diffraction diagrams which show the short spacings characteristic of a urea-fatty acid clathrate. The fatty acid employed to form the clathrate can be any free fatty acid capable of forming a clathrate, such as one of the above-mentioned fatty acids, or mixtures of them. It will normally be straight-chain and saturated or monoethenoid. The free fatty acid in the clathrate can have the same composition as that of the fat charge which is used to make the soap, or it can be different. Coconut oil fatty acid is particularly suitable for use in providing the clathrate. As the metal ions of the soap present in a soap bar can exchange within the individual soap compounds or be transferred to free fatty acid added after the soap is formed, it is convenient to regard the metal ions as distributed equally between the fatty acids present in the soap according to their molecular proportion, and to treat any free fatty acid added to the dried soap during the formation of the bar as not exchanging ions with the soap present.

The invention is particularly valuable in respect of soap bars containing moisturising compounds, such as disodium adipate, sodium malate or sodium lactate, and others described in U.S. Patent Applications Ser. Nos. 432,120 and 438,043, for such soap bars have a tendency to exhibit reduced lathering properties. The amount of moisturising compound used will generally be from 5 to 15% by weight of the total soap, urea and free fatty acid present. Soap bars of the invention can also contain sequestering agents, antioxidants, opacifiers, fluorescers and colourants.

In a process of the invention a toilet soap bar is made by incorporating in a toilet soap composition the required urea and free fatty acid under conditions to provide the clathrate, and forming the composition containing clathrate into a bar. The pre-formed clathrate, made for instance by heating together the urea and free fatty acid, can be dispersed in soap, preferably it is dispersed in the dried soap (having up to 15% of water) by milling. Alternatively the clathrate is formed in soap in situ. Wet soap (having more than 15% of water) containing urea and free fatty acid can be heated and then dried to form the clathrate. For instance the free fatty acid can be mixed with a neutral wet soap base containing the urea before drying and the heated liquid mixture passed through a conventional vacuum dryer, during which the clathrate is formed. A concentrated clathrate soap composition can be prepared containing from 40% to 70 or 90% of urea and free fatty acid by weight of total soap, urea and free fatty acid, and then dispersed in dried soap by milling, but preferably the wet soap contains the amount of soap required for the soap bar. The clathrate can also be formed in situ in the soap by dispersing the urea and free fatty acid in dried soap by milling: preferably the free fatty acid is dispersed in the dried soap already containing the urea. The urea is conveniently added as a fine powder and the fatty acid is conveniently added in the molten state, in order to promote dispersion. Adequate heating for formation of the clathrate can occur during a normal process of soap milling and plodding where the fatty acid has a melting point below processing temperature. The soap to which the clathrate is added or in which it is formed should of course be free of alkali.

The present invention provides further benefits, in that it permits a wider choice of fats from which to prepare a soap having good lathering properties, and it enables partial replacement of an expensive ingredient, namely fatty acids, by urea, which is cheap, without a corresponding loss of lathering properties.

The invention is illustrated by the following Examples, in which all amounts are by weight and temperatures are in °C: unless otherwise stated tablet composition amounts % are by total weight of dry soap, urea and free fatty acid.

In calculating the contents of the compositions in the Examples, total fatty matter was taken to be total fatty acid, and it was assumed (a) that sodium and potassium soaps were formed in the same molar ratio as that of the sodium and potassium present, irrespective of the chain length of the fatty acid concerned; (b) that any free fatty acid remaining after a saponification step had the same chain length distribution as the soap; and (c) any free fatty acid added during milling and plodding did not exchange with the fatty acid of the soap.

The procedures of the lather and wear tests were as follows.

Lather Volume Test

In this test a tablet is used by operators wearing thin rubber gloves to generate lather, simulating conditions of consumer use, according to a standard procedure using water of standard hardness at a standard temperature. A tablet which has been washed down well at least 10 minutes before the test is wetted and twisted 15 times between the hands in such a way that it turns over each time; the tablet is then set down and lather is generated from the liquor on the hands by rubbing the tips of the fingers of the left hand on the palm of the right hand 10 times forwards to the fingertips and back. The lather on the right hand is then collected by gripping above the wrist with the left hand and squeezing while moving it over the fingers, thus transferring the lather to between the forefinger and thumb of the left hand. The gripping and squeezing is repeated on the left hand using the right. This process of collection is repeated 5 times, leaving the lather collected on the right hand. This lather is collected with the fingers of the left hand and placed again in the palm of the right hand. The whole procedure of rubbing and collecting is repeated once again. The step of forming and collecting the lather should take about 30 seconds. The collected lather is placed in a beaker and the hands are then rinsed.

Two more batches of lather are made by the above procedure, and the combined lather in the beaker is gently stirred with a glass rod to release any large pockets of trapped air, the surface smoothed off with the fingers and the lather volume measured.

Three operators are used, each making tests in duplicate, and the results of all operators are averaged. The average lather volumes are reproduceable using the same panel of competent operators to within a margin of 10%.

Lather Creaminess Assessment

At the same time as lather volume is being generated, the operator makes a subjective assessment of the creaminess of the lather according to a scale of from 1 (not creamy) to 5 (extremely creamy); this assessment is reproduceable to within 0.5 units with a given operator.

Lather Viscosity Measurement

A sample of the lather generated in the lather volume test is transferred by suction to the measuring cup of a Haake Rotational Viscometer and the viscosity of the lather measured under standard conditions with a rotary bob MVIII at a shear rate of 24 $sec^{-1}$, readings being taken after 5 and 30 seconds shear and averaged. At scale readings of 20 to 25 differences of 2 are significant, and at higher readings the differences must be greater to be significant: thus with readings of 40 to 50, differences of less than 7 are not significant.

Wear Test

In this procedure wear of a tablet during consumer use is simulated by operators wearing thin rubber gloves. A weighed tablet is dipped in wash water of standard hardness and at a prescribed temperature and immediately twisted with rubbing between the hands 15 times in such a way that it turns over each time; it is then dipped in the water momentarily, twisted a further 15 times and placed on either a draining dish or a wet place (a flat plate holding 5 ml water).

The tablet is submitted to 6 such washdown procedures at regular intervals spaced apart as far as possible during each of 4 consecutive working days using a panel of 3 operators in rotation. It is then allowed to dry out for 3 days and is reweighed. The difference between the initial and final weights is the wear expressed in grams. This wear is adjusted by reference to standard wear figures for tablets of two standard soaps which are at the same time submitted to the procedure using the same operators, to give standardised wear values. Standardised wear values are reproduceable within a margin of 10%.

EXAMPLE 1

As soap base there was taken 9000 parts of a neutral wet sodium soap containing 63% of total fatty matter of which 58% was tallow fatty acid and 42% coconut oil fatty acid. To this soap base at 80° was added 1200 parts of urea and 450 parts of free coconut oil fatty acid and the composition was mixed until it was homogeneous. 9.4 Parts of a 20% aqueous solution of tetrasodium ethylenediamine tetraacetate, 2.2 parts of a 60% aqueous solution of 1-hydroxy-ethane-1,1-diphosphonic acid and 7.2 parts of 2,6-di-t-butyl-4-hydroxytoluene dissolved in a little methylated spirits were added with mixing, and the temperature of the mass was raised to 140° under superatmospheric pressure. The mass was then sprayed into a chamber where the pressure was maintained at 30 mm of mercury, to produce a dried soap composition which was collected and extruded at 30° as noodles of 12% moisture content.

10000 Parts of the soap noodles thus obtained were mixed at ambient temperature with 100 parts of perfume, 30 parts of a titanium dioxide opacifier and 50 parts of a colourant suspension. The resulting mixture was milled and plodded in conventional equipment, cut into billets and stamped into tablets containing 78.9% soap and the clathrate (20.4%) derived from 15.3% urea and 5.7% free fatty acid.

The tablets had excellent lathering and creaminess properties, much superior to those of similar tablets in which either or both the urea and the free fatty acid were absent.

EXAMPLE 2

Urea (8853 parts) was dissolved in an aqueous solution containing sodium hydroxide (914 parts), potassium hydroxide (375 parts) and water (4080 parts), the solution heated to 60° and to it were added at 60° coconut oil fatty acid (average MW 207, 5902 parts), a fully hardened tallow fatty acid (average MW 274, 2497 parts) and sodium dihydrogen phosphate dihydrate (454 parts), the mixture stirred and heated to boiling until its water content had been reduced to 4% by evaporation, and then cooled and converted into flakes by milling. The resulting concentrated clathrate soap composition (19121 parts) contained soap (7349 parts) and free fatty acid (1806 parts) as clathrate.

A neutral dried sodium soap in chip form (1400 parts) containing 10% of water and 81% of total fatty matter, of which 58% was a tallow fatty acid of MW 276 and 42% was coconut oil fatty acid of MW 207, was mixed with the concentrated clathrate soap composition (600 parts), and the mixture milled, plodded and shaped into tablets (100g). The resulting tablets contained 81.4% soap, 15.4% total urea and 3.1% free fatty acid as clathrate (12.6%).

For comparison as composition A, tablets were similarly made from the soap chips without addition of concentrated clathrate soap composition.

The tablets were subjected to a lather volume test, lather creaminess assessment and lather viscosity measurement, with the following results.

| Composition | Temperature | Lather | | |
|---|---|---|---|---|
| | | Volume | Creaminess | Viscosity |
| Example 2 | 20 ° | 642 | 3.8 | 59 |
| | 40 ° | 642 | 3.9 | 64 |
| A | 20 ° | 346 | 2.7 | 24 |
| | 40 ° | 408 | 2.6 | 25 |

EXAMPLE 3

Soap tablets were prepared as in Example 2, except that the neutral dried sodium soap was derived from 80% of the tallow fatty acid and 20% of the coconut oil fatty acid. The tablets with added clathrate contained 81.4% soap, 15.5% urea and 3.1% free fatty acid as clathrate (12.6%). For comparison as composition B, tablets were made as before from the soap chips with no added concentrated clathrate soap composition, and the tablets tested.

| Composition | Temperature | Lather | | |
|---|---|---|---|---|
| | | Volume | Creaminess | Viscosity |
| Example 3 | 20 ° | 583 | 3.5 | 42 |
| | 40 ° | 567 | 3.6 | 52 |
| B | 20 ° | 296 | 2.7 | 22 |
| | 40 ° | 254 | 2.3 | 25 |

EXAMPLES 4 to 8

Urea (5800 parts) was dissolved in an aqueous solution containing sodium hydroxide (600 parts), potassium hydroxide (250 parts), and water (6500 parts), the solution heated to 60°, and to it were added at 60° coconut oil fatty acid (MW 207, 3850 parts), a fully hardened tallow fatty acid (MW 274, 1550 parts) and sodium dihydrogen phosphate dihydrate (309 parts), the mixture stirred and heated to boiling until its water content had been reduced to 4% by evaporation, and then cooled and converted into flakes by milling. The resulting concentrated clathrate soap composition (12436 parts) contained soap (4932 parts) and free fatty acid (1069 parts) as clathrate.

Tablets were prepared with increasing amounts of the composition milled into the neutral dried sodium soap of Example 2, and tablets were also prepared from the soap chips alone and from the concentrated clathrate soap composition alone, as compositions C and D.

The amounts of ingredients and the contents of the resulting tablets were as follows:

| Composition | Dried soap chips | Clathrate soap composition | % Soap | % Urea | % Fatty acid | % Clathrate |
|---|---|---|---|---|---|---|
| C | 1000 | 0 | 100 | 0 | 0 | 0 |
| Example 4 | 900 | 100 | 93.8 | 5.3 | 1.0 | 3.9 |
| Example 5 | 800 | 200 | 87.7 | 10.4 | 1.9 | 7.7 |
| Example 6 | 700 | 300 | 81.6 | 15.6 | 2.9 | 11.4 |
| Example 7 | 600 | 400 | 75.6 | 20.6 | 3.8 | 15.2 |
| Example 8 | 500 | 500 | 69.7 | 25.6 | 4.7 | 18.8 |
| D | 0 | 1000 | 41.3 | 49.6 | 9.1 | 36.5 |

The tablets thus obtained were subjected to lather tests as before and also to wear tests, with the following results.

| | Lather | | | Wear | |
|---|---|---|---|---|---|
| Composition | Volume | Creaminess | Viscosity | Draining dish | Wet plate |
| At 20 ° | | | | | |
| C | 333 | 2.6 | 19 | 10.4 | |
| Example 4 | 475 | 2.8 | 26 | 16.6 | |
| Example 5 | 500 | 3.0 | 36 | 19.5 | |
| Example 6 | 604 | 3.1 | 29 | 18.4 | |
| Example 7 | 613 | 3.6 | 49 | 19.5 | |
| Example 8 | 592 | 3.5 | 47 | 22.7 | |
| D | 583 | 3.8 | 56 | 46.5 | |
| At 40 ° | | | | | |
| C | 375 | 2.7 | 36 | 28.1 | 29.3 |
| Example 4 | 450 | 2.9 | 31 | 33.5 | 31.9 |
| Example 5 | 525 | 3.3 | 45 | 35.8 | 34.0 |
| Example 6 | 621 | 3.2 | 36 | 38.1 | 38.8 |
| Example 7 | 633 | 3.6 | 63 | 37.9 | 38.5 |
| Example 8 | 671 | 3.8 | 66 | 45.0 | 46.8 |
| D | 613 | 4.3 | 54 | 66.2 | 83.1 |

The tablets of Examples 4 to 8 show lathering properties which are better than those which would be predicted from the results obtained with compositions C and D, without the unacceptable wear rate shown by composition D.

EXAMPLES 9 and 10

Urea (600 parts) and a mixture of fatty acids (200 parts) consisting of lauric acid (70 parts), palmitic acid (110 parts) and hardened tallow fatty acid (MW 274, 20 parts) were dissolved in hot methanol (about 500 parts) and the solution cooled to 0°, and the crystals of clathrate which formed on standing were filtered off and vacuum-dried.

The clathrate (288 parts), urea (64 parts), a neutral dried sodium soap (1400 parts) containing 10% water and 81% total fatty matter, of which 58% was tallow fatty acid (MW 276) and 42% was coconut oil fatty acid (MW 207), and a neutral soap (200 parts) containing 10% water and 81% total fatty matter, of which 85% was coconut oil fatty acid and 15% was hardened tallow fatty acid (MW 274), the soap being a mixture of sodium and potassium salts in the weight ratio 70 : 30, were mixed, milled together, plodded and shaped into tablets.

The process was repeated, except that instead of initially preparing the urea clathrate composition, the equivalent amounts of urea and the mixture of fatty acids were milled directly into the mixed soap base.

Tablets from corresponding compositions E and F were prepared in which urea only and the mixture of fatty acids only were milled into the soap base. These formulations were made from the sodium soap (1480 parts), the mixed sodium/potassium soap (205 parts) and urea (296 parts); and the sodium soap (1700 parts), the mixed sodium/potassium soap (230 parts) and the mixture of fatty acids (86 parts), respectively.

The resulting tablets had the following composition.

| Composition | Component added | % Soap | % Urea | % Fatty acid | % Clathrate |
|---|---|---|---|---|---|
| Example 9 | Clathrate | 80.1 | 15.9 | 4.1 | 16.3 |
| Example 10 | Urea and fatty acid | 80.1 | 15.9 | 4.1 | 16.3 |
| E | Urea only | 83.4 | 16.6 | 0 | 0 |
| F | Fatty acid only | 95.2 | 0 | 4.8 | 0 |

The tablets thus obtained were tested, with the following results.

| Composition | Lather | | | | | |
|---|---|---|---|---|---|---|
| | Volume | | Creaminess | | Viscosity | |
| | 20 ° | 40 ° | 20 ° | 40 ° | 20 ° | 40 ° |
| Example 9 | 592 | 688 | 3.5 | 3.7 | 49 | 54 |
| Example 10 | 608 | 654 | 3.5 | 3.7 | 46 | 55 |
| E | 467 | 446 | 2.5 | 2.8 | 25 | 35 |
| F | 678 | 696 | 3.0 | 3.4 | 32 | 51 |

EXAMPLE 11

A concentrated clathrate soap composition was prepared as in Examples 4 to 8, but using urea (4640 parts), sodium hydroxide (475 parts), potassium hydroxide (200 parts), water (5200 parts), coconut oil fatty acid (3080 parts), fully hardened tallow fatty acid (1250 parts) and phosphate (250 parts), and after drying, the composition (10,200 parts) contained soap (4037 parts) and free fatty acid (891 parts). Tablets were prepared from the neutral dried sodium soap of Example 2 (6800 parts), the concentrated clathrate soap composition (3000 parts), and contained 80.9% soap, 16.2% urea and 2.9% fatty acid as clathrate (11.7%). These tablets were tested, with the following results.

| Temperature | Lather | | |
|---|---|---|---|
| | Volume | Creaminess | Viscosity |
| 20 ° | 667 | 3.6 | 48 |
| 40 ° | 629 | 3.6 | 49 |

EXAMPLE 12

Into a neutral dried soap (1640 parts) containing 8% water and 81% of total fatty matter, of which 45% was tallow fatty acid (MW 276) and 55% coconut oil fatty acid (MW 207), the soap being a mixture of sodium and potassium salts in the weight ratio 65:3, was milled a mixture of fatty acid (135 parts) consisting of myristic acid (84 parts), palmitic acid (19 parts) and stearic acid (5 parts), followed by urea (280 parts), and tablets were prepared by plodding and shaping. The tablets contained 77.8% soap, 15.0% urea and 7.2% fatty acid as urea clathrate (20.0%), and were tested with the following results.

| Temperature | Lather | | |
|---|---|---|---|
| | Volume | Creaminess | Viscosity |
| 20 ° | 617 | 3.4 | 51 |
| 40 ° | 767 | 3.8 | 53 |

EXAMPLE 13

Soap tablets were prepared as in Example 1, but using 9000 parts of the neutral wet sodium soap, 1230 parts of urea and 570 parts of the free fatty acid. The resulting tablets contained 77.4% soap, 15.4% urea, 7.2% free fatty acid as clathrate (20.6%), and were tested, with the following results.

| Temperature | Lather | | |
|---|---|---|---|
| | Volume | Creaminess | Viscosity |
| 20 ° | 654 | 3.3 | 45 |
| 40 ° | 750 | 3.5 | 54 |

EXAMPLES 14 to 17

A clathrate was prepared from urea (3 parts) and coconut oil fatty acid (MW 207, 1 part) by dissolving them together in hot water and removing the water by evaporation under reduced pressure.

The dried clathrate (2250 parts) was then incorporated into each of two soap bases (6750 parts) having 10% water and 81% total fatty matter of which 58% and 80% respectively was hardened tallow fatty acid (MW 274) and 42 and 20% respectively was coconut oil fatty acid (MW 207).

Another clathrate was prepared in the same way, except that instead of coconut oil fatty acid there was used hardened tallow fatty acid (MW 274). This clathrate was likewise incorporated into each of the above two soap bases.

The resulting soap compositions were milled, plodded and shaped into tablets containing ingredients as follows.

| Example | Ratio of soap base acids | Acid of Clathrate | Soap % | Urea % | Fatty acid % | Clathrate % |
|---|---|---|---|---|---|---|
| 14 | 58:42 | Coconut oil | 72.6 | 20.5 | 6.8 | 27.2 |
| 15 | 58:42 | Hardened tallow | 72.6 | 20.5 | 6.8 | 27.2 |
| 16 | 80:20 | Coconut oil | 72.0 | 21.0 | 7.0 | 28.0 |
| 17 | 80:20 | Hardened tallow | 72.0 | 21.0 | 7.0 | 28.0 |

Tablets were also prepared as compositions G and H from each soap base. All tablets were then tested, with the following results.

| Composition | Lather | | | | | |
|---|---|---|---|---|---|---|
| | Volume | | Creaminess | | Viscosity | |
| | 20 ° | 40 ° | 20 ° | 40 ° | 20 ° | 40 ° |
| Example 14 | 504 | 663 | 3.1 | 3.4 | 42 | 50 |

-continued

| Composition | Lather Volume | | Lather Creaminess | | Lather Viscosity | |
|---|---|---|---|---|---|---|
| Example 15 | 679 | 804 | 3.3 | 3.5 | 45 | 63 |
| G | 446 | 467 | 2.5 | 2.7 | 25 | 40 |
| Example 16 | 388 | 646 | 2.9 | 3.5 | 37 | 58 |
| Example 17 | 217 | 375 | 2.7 | 3.2 | 38 | 63 |
| H | 329 | 363 | 2.6 | 2.9 | 24 | 30 |

EXAMPLES 18 to 23

Urea (6 parts) and coconut oil fatty acid (MW 207, 2 parts) were dissolved in hot methanol (about 5 parts) and the solution cooled to 0°, and the crystals of clathrate which formed on standing were filtered off and dried.

Into a neutral dried sodium soap base (11,100 parts) containing 10% water and 81% total fatty matter, of which 58% was tallow fatty acid (MW 276) and 42% was coconut oil fatty acid (MW 207) was milled as plasticiser a sodium $C_{10}$ to $C_{15}$ alkyl benzene sulphonate (222 parts), to give a base composition to which various amounts of the clathrate were added and tablets prepared by milling, plodding and shaping. The amounts of ingredients and the composition of the tablets were as follows.

| Example | Base soap composition | Clathrate | % Soap | % Urea | % Fatty acid | % Clathrate |
|---|---|---|---|---|---|---|
| 18 | 95 | 5 | 94.3 | 4.3 | 1.4 | 5.7 |
| 19 | 90 | 10 | 88.6 | 8.5 | 2.8 | 11.3 |
| 20 | 85 | 15 | 83.1 | 12.7 | 4.2 | 16.9 |
| 21 | 80 | 20 | 77.6 | 16.8 | 5.6 | 22.4 |
| 22 | 75 | 25 | 72.2 | 20.9 | 7.0 | 27.8 |
| 23 | 70 | 30 | 66.9 | 24.8 | 8.3 | 33.1 |

Tablets were also prepared from the base soap composition (Composition I). The tablets thus obtained were tested, with the following results.

| Composition | Lather Volume | | Lather Creaminess | | Lather Viscosity | |
|---|---|---|---|---|---|---|
| | 20 ° | 40 ° | 20 ° | 40 ° | 20 ° | 40 ° |
| I | 438 | 471 | 2.3 | 2.9 | 21 | 40 |
| Example 18 | 517 | 525 | 2.6 | 2.9 | 29 | 40 |
| Example 19 | 613 | 596 | 2.8 | 3.2 | 26 | 39 |
| Example 20 | 671 | 679 | 3.1 | 3.3 | 29 | 56 |
| Example 21 | 592 | 738 | 3.5 | 3.6 | 41 | 62 |
| Example 21 | 592 | 746 | 3.3 | 3.8 | 41 | 58 |
| Example 23 | 594 | 696 | 3.1 | 3.8 | 41 | 67 |

EXAMPLE 24 and 25

As soap base there was taken 150 parts of a neutral wet sodium soap containing 63% of total fatty matter of which 58% was tallow fatty acid and 42% coconut oil fatty acid. To this soap base at 80° was added 22.5 parts of urea and 7.5 parts of coconut oil fatty acid, 0.2 parts of a 20% aqueous solution of tetrasodium ethylenediamine tetraacetate, and 0.04 parts of a 60% aqueous solution of 1-hydroxyethane-1,1-diphosphonic acid and the composition was mixed until it was homogeneous. The temperature was raised to 120° under superatmospheric pressure and the mixture sprayed into a chamber where the pressure was maintained at 28 mm of mercury, to produce a dried soap composition which was collected and extruded at 30° as noodles of 12% moisture content. 19.68 Parts of the soap noodles were mixed at ambient temperature with 0.16 parts of perfume, 0.058 parts of titanium dioxide opacifier and 0.082 parts of a colourant suspension. Tablets (Example 24) were made from the composition by milling, plodding and stamping.

A second batch of tablets (Example 25) was made using the composition to which an equal weight of the neutral sodium soap which had been dried in the same way had been added. A third batch of tablets (composition J) was prepared by mixing the neutral wet sodium soap (9527 parts) with free coconut oil fatty acid (472 parts) and dried in a similar manner.

The tablets had the following composition.

| | % Soap | % Urea | % Fatty acid | % Clathrate |
|---|---|---|---|---|
| Example 24 | 77.4 | 16.9 | 5.6 | 22.6 |
| Example 25 | 88.6 | 8.5 | 2.8 | 11.4 |
| Composition J | 93.8 | 0 | 6.2 | 0 |

The tablets were tested, with the following results.

| Composition | Lather Volume | | Lather Creaminess | | Lather Viscosity | |
|---|---|---|---|---|---|---|
| | 20 ° | 40 ° | 20 ° | 40 ° | 20 ° | 40 ° |
| Example 24 | 729 | 771 | 3.3 | 3.7 | 49 | 56 |
| Example 25 | 638 | 700 | 3.2 | 3.4 | 32 | 52 |
| J | 646 | 704 | 2.9 | 3.7 | 34 | 61 |

These results show that a more effective use of the free fatty acid present to provide good lathering properties is obtained by using the fatty acid as urea clathrate.

EXAMPLE 26

Into a neutral dried sodium soap (8000 parts) containing 10% water and 81% total fatty matter, of which 58% was tallow fatty acid (MW 276) and 42% was coconut oil fatty acid (MW 207) was milled urea (1500 parts), followed by a molten mixture (500 parts) containing equal quantities by weight of coconut oil fatty acid and hardened tallow fatty acid (MW 274), and tablets were prepared by plodding and shaping. The tablets contained 77.8% soap, 16.6% urea and 5.5% fatty acid as clathrate (22.1%), and were tested, with the following results.

| Temperature | Lather Volume | Lather Creaminess | Lather Viscosity |
|---|---|---|---|
| 20 ° | 725 | 2.8 | 25 |
| 40 ° | 767 | 3.1 | 28 |

EXAMPLE 27

A mixture of urea (3 parts) and coconut oil fatty acid (MW 207, 1 part) was prepared by dispersing the urea in the molten fatty acid at 90°. The cooled and powdered mixture (2000 parts) was then incorporated into a soap base (8000 parts) having 14% water and 78% total fatty matter of which 80% was hardened tallow fatty acid (MW 274) and 20% was coconut oil fatty acid (MW 207), and soap tablets prepared by milling, plodding and shaping. The resulting tablets contained 77.4% soap, 17.0% urea and 5.6% fatty acid as clathrate (22.6%), and tested for lathering properties with the following results.

| Temperature | Lather | | |
|---|---|---|---|
| | Volume | Creaminess | Viscosity |
| 20 ° | 600 | 3.1 | 34 |
| 40 ° | 588 | 3.1 | 43 |

EXAMPLES 28 to 30

Into a neutral dried sodium soap in chip form (8000 parts), containing 10% water and 81% total fatty matter, of which 85% was tallow fatty acid (MW 276) and 15% was coconut oil fatty acid (MW 207), was milled free coconut oil fatty acid (500 parts), followed by urea (1500 parts), and the resulting composition plodded and shaped into tablets.

Similar tablets were prepared using soaps based on different proportions of tallow and coconut oil fatty acids. Tablets were also made from the soap bases, as compositions K, L and M. The proportions of the acids and composition of the resulting tablets were as follows.

| Composition | Tallow acid: coconut oil acid | % Soap | % Urea | % Fatty acid | % Clathrate |
|---|---|---|---|---|---|
| Example 28 | 85:15 | 77.8 | 16.6 | 5.5 | 22.2 |
| K | | 100 | 0 | 0 | 0 |
| Example 29 | 90:10 | 77.8 | 16.6 | 5.5 | 22.2 |
| L | | 100 | 0 | 0 | 0 |
| Example 30 | 95:5 | 77.8 | 16.7 | 5.6 | 22.2 |
| M | | 100 | 0 | 0 | 0 |

The tablets were tested, with the following results.

| Composition | Lather | | | | | |
|---|---|---|---|---|---|---|
| | Volume | | Creaminess | | Viscosity | |
| | 20 ° | 40 ° | 20 ° | 40 ° | 20 ° | 40 ° |
| Example 28 | 504 | 638 | 2.8 | 2.9 | 23 | 26 |
| K | 283 | 304 | 2.3 | 2.4 | 26 | 26 |
| Example 29 | 504 | 479 | 2.7 | 2.8 | 30 | 48 |
| L | 233 | 250 | 2.3 | 2.4 | 19 | 25 |
| Example 30 | 283 | 350 | 2.4 | 2.8 | 32 | 40 |
| M | 175 | 217 | 2.2 | 2.3 | 19 | 21 |

EXAMPLES 31 to 34

Soap tablets were prepared as in Example 26, except that the free fatty acid used was coconut oil fatty acid, and the water content of the dried sodium soap and amounts of urea and fatty acid were different. The resulting soap tablets had the following composition, the water content being of the whole tablet composition.

| Example | % Soap | % Urea | % Fatty acid | % Clathrate | % Water |
|---|---|---|---|---|---|
| 31 | 74.1 | 16.9 | 9.0 | 22.5 | 11 |
| 32 | 70.9 | 16.8 | 12.3 | 22.4 | 10 |
| 33 | 74.7 | 16.5 | 8.8 | 22.0 | 6 |
| 34 | 71.5 | 16.5 | 12.1 | 22.0 | 8 |

The tablets were tested, with the following results.

| Example | Lather | | | | | |
|---|---|---|---|---|---|---|
| | Volume | | Creaminess | | Viscosity | |
| | 20 ° | 40 ° | 20 ° | 40 ° | 20 ° | 40 ° |
| 31 | 608 | 729 | 3.3 | 3.6 | 41 | 49 |
| 32 | 600 | 708 | 3.2 | 3.4 | 52 | 57 |
| 33 | 638 | 725 | 3.4 | 3.6 | 53 | 58 |
| 34 | 608 | 717 | 3.4 | 3.7 | 50 | 58 |

EXAMPLE 35

Soap tablets were prepared as in Example 24, except that 7.5 parts of hardened tallow fatty acid (MW 274) were incorporated in the soap base instead of the coconut fatty acid, and instead of 19.68 parts of the soap noodles, 19.1 parts together with 0.58 parts of a dried potassium soap equivalent to the sodium soap and of 10% water content was used. The tablets contained 78.23% soap, 16.4% urea and 5.4% fatty acid as clathrate (21.8%), and gave the following test results.

| Temperature | Lather | | |
|---|---|---|---|
| | Volume | Creaminess | Viscosity |
| 20 ° | 704 | 3.3 | 45 |
| 40 ° | 642 | 3.5 | 54 |

EXAMPLE 36

Soap tablets were prepared as in Example 24, except that the neutral wet sodium soap taken contained 63% of total fatty matter of which 70% was tallow fatty acid and 30% coconut oil fatty acid, and 15.75 parts of urea and 5.25 parts of free coconut oil fatty acid; and instead of 19.68 parts of the soap noodles, 19.1 parts together with 0.58 parts of a dried potassium soap equivalent to the sodium soap and of 10% water content, were used. The tablets contained 83.0% soap, 12.7% urea and 4.2% fatty acid as clathrate (16.9%), and gave the following test results.

| Temperature | Lather | | |
|---|---|---|---|
| | Volume | Creaminess | Viscosity |
| 20 ° | 596 | 3.2 | 38 |
| 40 ° | 571 | 3.4 | 40 |

EXAMPLE 37

To molten coconut oil fatty acid (MW 207, 1 part) at 30° was added urea (3 parts) with stirring and the mixture heated to 90° for 15 minutes, during which formation of clathrate was indicated by an increase in viscosity. The product solidified on cooling.

To 82.5 parts of a neutral dried sodium soap of 10% water content and 81% total fatty matter provided by 58% of tallow fatty acid and 42% coconut oil fatty acid were added 2.5 parts of the equivalent potassium soap, 10 parts of the urea clathrate, 5 parts of molten coconut oil fatty acid, 1.2 parts perfume, 0.3 parts titanium dioxide and 0.48 parts of colourant suspension : the mixture was milled, plodded and shaped into soap tablets containing 83.1% soap, 8.4% urea and 8.4% free fatty acid as clathrate (11.3%). The tablets gave the following test results.

| Temperature | Lather | | |
|---|---|---|---|
| | Volume | Creaminess | Viscosity |
| 20 ° | 725 | 3.7 | 49 |
| 40 ° | 754 | 3.6 | 52 |

EXAMPLE 38

To a superfatted soap base (813 parts) of 9% water content and containing 658 parts of anhydrous sodium soap of which 58% was tallow fatty acid and 42% was coconut oil fatty acid, and 8.4% of free coconut oil fatty acid, was added an aqueous paste (71.4 parts) containing 63% of sodium $C_{10}$ to $C_{15}$ alkylbenzene sulfonate as plasticiser and an aqueous slurry (192 parts) containing 52% of disodium adipate as moisturising agent, and the composition mixed to a homogeneous paste which was passed through a roller mill and oven-dried at 80°. To the resulting flakes was added urea coconut oil fatty acid clathrate (prepared as in Example 37, 42 parts) and the mixture milled, plodded and shaped into tablets containing 72.2% soap, 3.4% urea as clathrate (4.5%), 8.6% of free coconut oil fatty acid, 10.8% sodium adipate and 4.9% alkylbenzene sulphonate, by total weight of these components. The tablets had excellent lathering properties.

EXAMPLE 39

Tablets were prepared as in Example 38, except that instead of the sodium adipate slurry there was used a 52% slurry of sodium malate, and had similar lathering properties.

EXAMPLE 40

Tablets are prepared as in Example 38, except that instead of the sodium adipate slurry there are used 143 parts of a 70% aqueous slurry of sodium lactate, and similar results are obtained.

What is claimed is:

1. A toilet soap bar containing a superfatting agent, wherein the superfatting agent is a clathrate of urea and a free straight-chain fatty acid having from about 8 to about 22 carbon atoms, the ratio of urea to the free fatty acid being from about 0.1:1 to about 10:1 by weight, and the combined amount of urea and the free fatty acid present being from about 2 to about 40% by weight of the total soap, urea and free fatty acid.

2. A soap bar according to claim 1, wherein the ratio of urea to the free fatty acid present is from 0.3:1 to 3.5:1.

3. A soap bar according to claim 1, wherein the combined amount of urea and the free fatty acid is from 5 to 25%.

4. A soap bar according to claim 2, wherein the combined amount of urea and the free fatty acid is from 8 to 20%.

5. A soap bar according to claim 1, wherein the fatty acid of the soap present comprises from 30 to 95 parts tallow fatty acid and from 70 to 5 parts coconut oil fatty acid by weight.

6. A soap bar according to claim 5, wherein the free fatty acid is coconut oil fatty acid.

* * * * *